US007569787B2

(12) United States Patent
Kurasawa et al.

(10) Patent No.: US 7,569,787 B2
(45) Date of Patent: Aug. 4, 2009

(54) ELECTROMAGNETIC SWITCH OF STARTER

(75) Inventors: Tadahiro Kurasawa, Chita-gun (JP); Kazuhiro Andoh, Okazaki (JP); Yamato Utsunomiya, Kariya (JP)

(73) Assignee: Denso Corporation, Kariya (JP)

( * ) Notice: Subject to any disclaimer, the term of this patent is extended or adjusted under 35 U.S.C. 154(b) by 96 days.

(21) Appl. No.: 11/797,474

(22) Filed: May 3, 2007

(65) Prior Publication Data

US 2007/0284234 A1 Dec. 13, 2007

(30) Foreign Application Priority Data

Jun. 12, 2006 (JP) ..... 2006-162567

(51) Int. Cl.
*H01H 5/00* (2006.01)

(52) U.S. Cl. ..... 200/400; 200/51.04

(58) Field of Classification Search ..... 200/51.04, 200/16 R, 504; 335/5, 83, 133, 196
See application file for complete search history.

(56) References Cited

U.S. PATENT DOCUMENTS 3,848,206 A * 11/1974 Prouty et al. ..... 335/193
4,203,084 A * 5/1980 Yamaguchi et al. ..... 335/202
4,243,964 A * 1/1981 Bogner et al. ..... 335/156
4,318,065 A * 3/1982 Harbauer ..... 335/17
4,871,893 A * 10/1989 Slovak et al. ..... 200/16 R
5,103,107 A * 4/1992 Yamamoto et al. ..... 290/48
5,132,653 A * 7/1992 Nakatake et al. ..... 335/202
5,420,555 A * 5/1995 Toguchi et al. ..... 335/185
5,488,207 A * 1/1996 Niwa et al. ..... 200/43.04
5,548,260 A * 8/1996 Kogure et al. ..... 335/126
5,812,041 A * 9/1998 Ishikawa et al. ..... 335/126
6,650,210 B1 * 11/2003 Raklyar et al. ..... 335/4
7,157,996 B2 * 1/2007 Enomoto et al. ..... 335/132
7,321,281 B2 * 1/2008 Molyneux et al. ..... 335/202

FOREIGN PATENT DOCUMENTS

JP A 5-126018 5/1993
JP 406046545 A * 2/1994 ..... 335/68

* cited by examiner

*Primary Examiner*—Michael A Friedhofer
*Assistant Examiner*—Lisa N Klaus
(74) *Attorney, Agent, or Firm*—Oliff & Berridge, PLC

(57) ABSTRACT

An electromagnetic switch has a shaft and a movable contact member slidably supported by the shaft. The shaft is moved with a plunger when an electromagnet is formed of an electromagnetic coil receiving an electric current and attracts the plunger. The movable contact member is moved with the plunger and connects fixed contact members with each other to turn on the switch. The shaft has a shaft body and a projection projected from the shaft body. The movable contact member has a hole. The projection is inserted into the hole to pass through the hole, and the movable contact member is disposed on the shaft body. Then, the movable contact member is rotated so as to engage the projection with the movable contact member. Therefore, the projection prevents the movable contact member from coming out of the shaft.

8 Claims, 8 Drawing Sheets

ELECTROMAGNETIC SWITCH OF STARTER

CROSS-REFERENCE TO RELATED APPLICATION

This application is based upon and claims the benefit of priority of the prior Japanese Patent Application 2006-162567 filed on Jun. 12, 2006 so that the contents of which are incorporated herein by reference.

BACKGROUND OF THE INVENTION

1. Field of the Invention

The present invention generally relates to an electromagnetic switch of a starter, for example, used for a vehicle, and more particularly to an electromagnetic switch wherein a movable contact member is connected with fixed contact members to turn on the switch.

2. Description of Related Art

An electromagnetic switch of a starter is used to start driving an engine of a vehicle by supplying an electric current from a battery to a motor through the turned-on switch. An electromagnetic switch has been, for example, disclosed in Published Japanese Patent First Publication No. H05-126018.

This switch has two fixed contact members and a movable contact member. The fixed contact members are connected with a motor circuit of a starter and a battery, respectively. The movable contact member is fitted to a shaft connected with a plunger so as to be movable with the plunger. When the movable contact member comes in contact with the fixed contact members, the fixed contact members are electrically connected with each other through the movable contact member, the motor circuit receives an electric current from a battery through the contact members of the switch, and a motor is driven. In response to a rotational force of the motor, the driving of an engine is started. After the driving of the engine is continued due to the combustion of fuel, the movable contact member is detached from the fixed contact members, and the driving of the motor is stopped.

The movable contact member is slidably fitted to an end portion of the shaft fixed to the plunger through a set of insulating members. Further, a heated washer is fitted to an end of the shaft and is cooled. Therefore, the washer is tightly fixed to the shaft to prevent the movable contact member from coming out.

However, in the switch disclosed in the Patent Publication, to fix the movable contact member to the shaft, in addition to many parts such as a set of insulating members and a washer, it is required to heat and cool the washer. Therefore, a cost for manufacturing the switch is heightened, and it is difficult to downsize the switch.

In another electromagnetic switch, a movable contact member is directly attached to a shaft without using an insulator. FIG. 1A shows a movable contact member not yet attached to a shaft, and FIG. 1B shows the movable contact member attached to the shaft. As shown in FIG. 1A, a circular flange 110 disposed at an end of a shaft 100 is inserted into a circular hole 210 opened in a movable contact member 200 so as to place a body of the shaft 100 in the hole 210. Then, as shown in FIG. 1B, portions of the contact member 200 surrounding the shaft 100 are pressed towards the shaft 100 to caulk the contact member 200 and to tightly fix the shaft 100 to the contact member 200. The flange 110 and the caulking prevent the contact member 200 from coming out of the shaft 100.

However, in this fixing of the movable contact member shown in FIGS. 1A and 1B to the shaft 100, although the number of parts can be reduced, the caulking operation for the contact member 200 is required after insertion of the shaft 100 into the contact member 200. Therefore, a cost for manufacturing the switch is also heightened.

SUMMARY OF THE INVENTION

An object of the present invention is to provide, with due consideration to the drawbacks of the conventional electromagnetic switch, an electromagnetic switch of a starter wherein a movable contact member is easily fitted to a shaft at a low cost.

According to a first aspect of this invention, the object is achieved by the provision of an electromagnetic switch comprising an electromagnet, a shaft, two fixed contact members, respectively, connected with a power source and a motor circuit, and a movable contact member slidably supported by the shaft. The electromagnet generates a magnetic force in response to an electric current supplied to an electromagnetic coil and attracts a plunger toward a first direction to move the shaft with the plunger. In response to the movement of the shaft, the movable contact member connects the fixed contact members with each other. The shaft has a shaft body extending along the first direction and a projection projected from the shaft body along a second direction different from the first direction. The movable contact member has a hole in which the shaft body is disposed. The projection is engaged with the movable contact member.

Accordingly, the projection of the shaft can reliably maintain the shaft body in the hole of the movable contact member so as to prevent the movable contact member from coming out of the shaft, so that the movable contact member can easily be fitted to the shaft at a low cost.

According to a second aspect of this invention, the object is achieved by the provision of an electromagnetic switch comprising an insulator slidably supported by the shaft in addition to the electromagnet, the shaft, the fixed contact members and the movable contact member. The movable contact member is attached to the insulator to be slidably supported by the shaft through the insulator. The insulator has a hole in which the shaft body of the shaft is disposed. The projection is engaged with the insulator.

Accordingly, the projection of the shaft can reliably maintain the shaft body in the hole of the insulator so as to prevent the insulator from coming out of the shaft, so that the movable contact member attached to the insulator can easily be fitted to the shaft at a low cost.

According to a third aspect of this invention, the object is achieved by the provision of an electromagnetic switch comprising the electromagnet, the shaft, the insulator, the fixed contact members and the movable contact member. The insulator has a base portion slidably fitted to the shaft and a projecting portion projected from the base portion along a second direction different from the first direction. The movable contact member has a hole in which the base portion of the insulator is disposed. The projecting portion is engaged with the movable contact member Accordingly, the projecting portion of the insulator can reliably maintain the base portion in the hole of the movable contact member so as to prevent the movable contact member from coming out of the insulator, so that the movable contact member can easily be fitted to the shaft through the insulator at a low cost.

DETAILED DESCRIPTION OF THE PREFERRED EMBODIMENTS

Figure 1B:
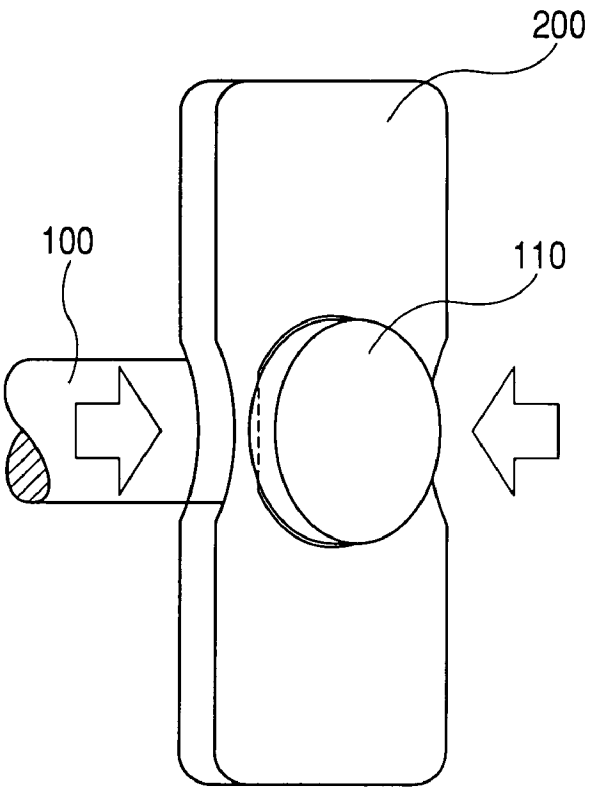
FIG. 1B (PRIOR ART)
FIG. 1B shows the movable contact member fitted to the shaft according to the prior art.
Figure 1A:
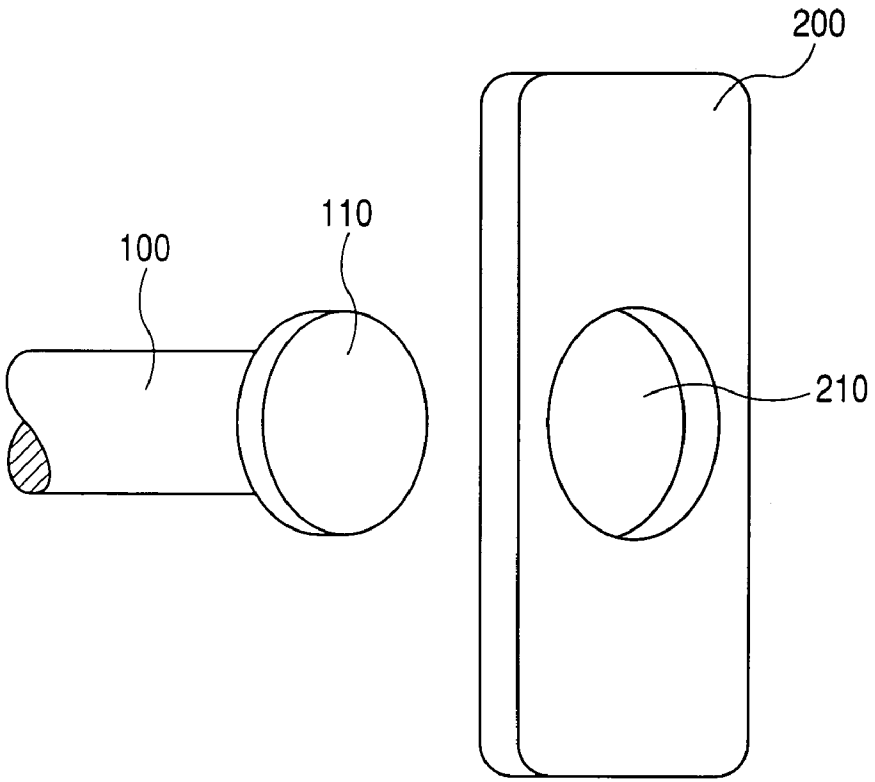
FIG. 1A (PRIOR ART)
FIG. 1A shows a movable contact member not yet fitted to a shaft according to a prior art.

Embodiments of the present invention will now be described with reference to the accompanying drawings, in which like reference numerals indicate like parts, members or elements throughout the specification unless otherwise indicated.

Embodiment 1

Figure 2:
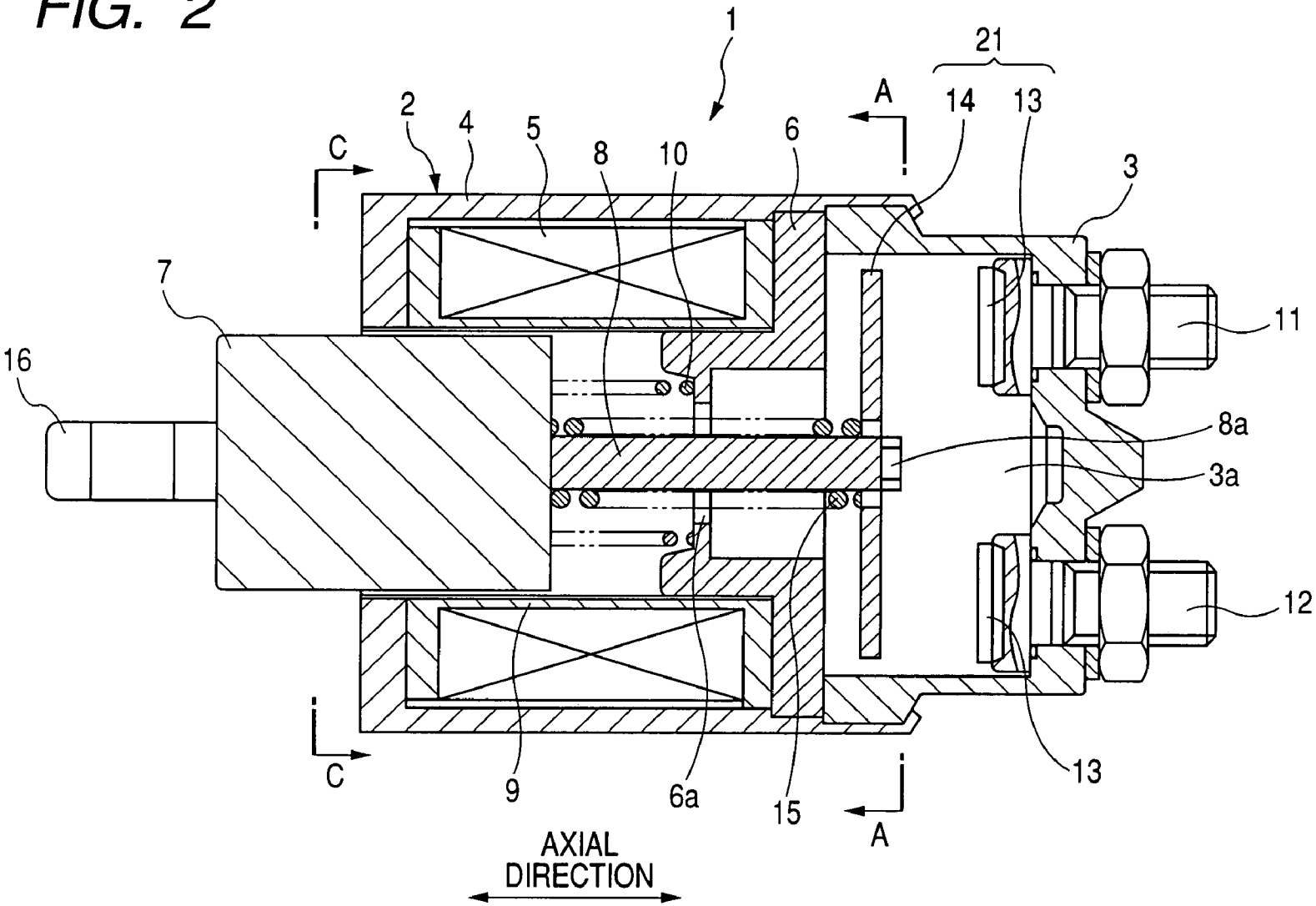
FIG. 2 is a longitudinal sectional view of an electromagnetic switch according to first to fourth embodiments of the present invention.

FIG. 2 is a longitudinal sectional view of an electromagnetic switch according to first to fourth embodiments. As shown in FIG. 2, an electromagnetic switch 1 has a solenoid 2 and a main contact unit 21 electrically connected with both a motor circuit (not shown) of a starter and a power source. The contact unit 21 is turned on and off in response to supply and no supply of an electric current to the solenoid 2. The switch 1 may further have a contact cover 3 to place the contact unit 21 within a contact member chamber 3*a* surrounded by the cover 3.

The solenoid 2 has a flowerpot-shaped switch frame 4 forming a yoke, a cylindrical electromagnetic coil 5 received within the frame 4, a fixed core 6 magnetized in response to the supply of an electric current to the coil 5, a plunger 7 inserted in a center open space of the coil 5 so as to be movable along an inner circumferential surface of the coil 5, and a shaft 8 movable with the plunger 7 along its axial direction. The coil 5 receiving the electric current forms an electromagnet, and the core 6 magnetized by the electromagnet strengthens a magnetic field induced by the coil 5.

The coil 5 is wound in two layers around a bobbin 9 made of resin. One of the layers of the coil 5 denotes an attraction coil for generating a magnetic force to attract the plunger 7 along the axial direction, and the other layer denotes a holding coil for generating a magnetic force to hold the plunger 7 attracted by the attraction coil.

The core 6 is disposed on an opening side of the frame 4 and forms a magnetic circuit in the periphery of the coil 5 in cooperation with the frame 4 and the plunger 7. The core 6 has a center hole 6*a* extending along the axial direction in its center, and the shaft 8 penetrates through the hole 6*a* and reaches the chamber 3*a*.

The plunger 7 is disposed so as to face the core 6 in the axial direction. A return spring 10 is disposed between the plunger 7 and the core 6. The spring 10 produces a force biasing the plunger 7 toward an anti-core direction (left direction in FIG. 2) so as to place the plunger 7 further away from the core 6.

The shaft 8 is made of an insulating material such as resin. One end of the shaft 8 is fixed to an end surface of the plunger 7 facing the core 6 by an adhesive or the like, and the other end of the shaft 8 passes through the hole 6*a* of the core 6 and enters the chamber 3*a* of the cover 3.

The cover 3 is, for example, formed by shaping resin. The cover 3 is disposed on the core 6 through a seal member (not shown) such as a rubber packing or the like. The cover 3 is fixed to an end portion of the frame 4 by caulking.

The contact unit 21 has two fixed contact members 13 and a movable contact member 14. Each of the contact members 13 and 14 is formed in a plate shape extending on a plane substantially perpendicular to the axial direction. Two external terminals 11 and 12 are fixed to the cover 3, and the contact members 13 are attached to ends of the external terminals 11 and 12, respectively. The terminal 11 is connected with a positive terminal of a power source such as an onboard battery (not shown) through a battery cable (not shown) and acts as a B terminal. The terminal 12 is connected with a motor circuit (not shown) through a lead wire (not shown) of a motor (not shown) and acts as an M terminal. The motor is earthed. The contact member 14 is slidably fitted to an end portion of the shaft 8 in the chamber 3*a*.

The shaft 8 has a bar-shaped shaft body and a projection 8*a* integrally formed with the shaft 8. The projection 8*a* is projected from the shaft body substantially along the radial direction. The projection 8*a* may be fitted to the shaft body to form the shaft 8. The projection 8*a* may be placed at a tip of the shaft 8 opposite to the plunger 7. A contact spring 15 is disposed between the plunger 7 and the contact member 14. The spring 15 produces a force biasing the contact member 14 toward the projection 8*a* of the shaft 8. That is, the spring 15 pushes the contact member 14 toward the right direction in FIG. 2 to make the contact member 14 keep in contact with the projection 8*a*.

Therefore, in response to the movement of the plunger 7 toward the core 6, the movable contact member 14 is movable toward the fixed contact members 13 to come in contact with the fixed contact members 13 and to electrically connect the fixed contact members 13 with each other. Further, in response to the movement of the plunger 7 toward the anti-core direction, the movable contact member 14 is movable toward the core 6 to detach from the fixed contact members 13 and to electrically disconnect the fixed contact members 13 from each other.

The switch 1 further has a joint 16 attached to the plunger 7 and placed on the opposite side of the shaft 8 with respect to the plunger 7. The joint 16 is connected with a shift lever (not shown) to shift the lever in response to the movement of the plunger 7.

An operation of the electromagnetic switch 1 is described below. When a starting switch (not shown)is turned on, an electric current is supplied from the battery to the coil 5 to form an electromagnet and to magnetize the core 6 due to a magnetic flux induced by the electromagnet. Therefore, an attraction force is generated by the electromagnet and is heightened by the core 6 such that the attraction force attracts the magnetized core 6 and plunger 7 each other. Because the core 6 is fixed to the frame 4, the plunger 7 is moved toward the core 6 while contracting the return spring 10 against a biasing force of the spring 10. In response to the movement of the plunger 7, the shaft 8 sliding with the plunger 7 is deeply pushed into the chamber 3*a*, and the contact member 14 fitted to the end portion of the shaft 8 comes in contact with the fixed contact members 13. The shaft 7 is still pushed into the chamber 3*l while contracting the springs* 10 *and* 15, 50 *that the contact member* 14 *receives a resilient force of the contracted spring* 15 *so as to heighten a contact force of the contact member* 14 *applied to the fixed contact members* 13.

Therefore, the fixed contact members 13 are electrically connected with each other through the contact member 14, and the switch 1 is turned on. In this condition, electric power of the battery is supplied to the motor through the terminal 11, the fixed contact members 13, contact member 14 and the terminal 12 to drive the motor. The driven motor applies a rotational force to a driving shaft (not shown). Further, in response to the movement of the plunger 7, a shift lever (not shown) is shifted by the joint 16 to move the driving shaft toward an engine (not shown). Therefore, the engine receives the rotational force from the driving shaft and starts a driving operation. After the driving of the engine is continued, the starting switch is automatically turned off, the supply of the electric current to the coil 5 is stopped, and the attraction force of the electromagnet disappears. In this condition, the plunger 7 is pushed back due to a reactive force of the return spring 10 in the anti-core direction so as to be away from the core 6, and the contact member 14 is detached from the fixed contact members 13. Therefore, the switch 1 is turned off, the supply of the electric power to the motor is stopped, and the driving of the motor is stopped.

Figure 3B:
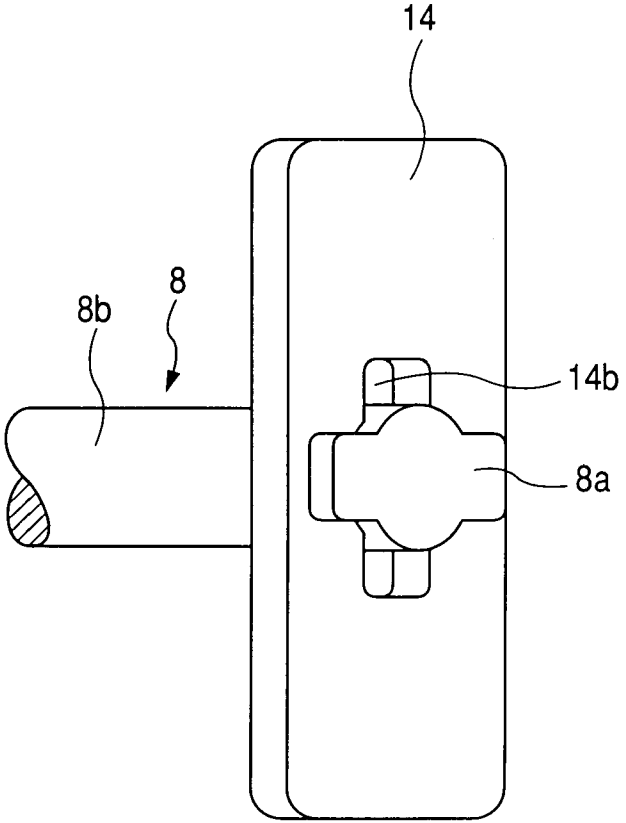
FIG. 3B shows the contact member fitted to the shaft 8 according to the first embodiment.
Figure 3A:
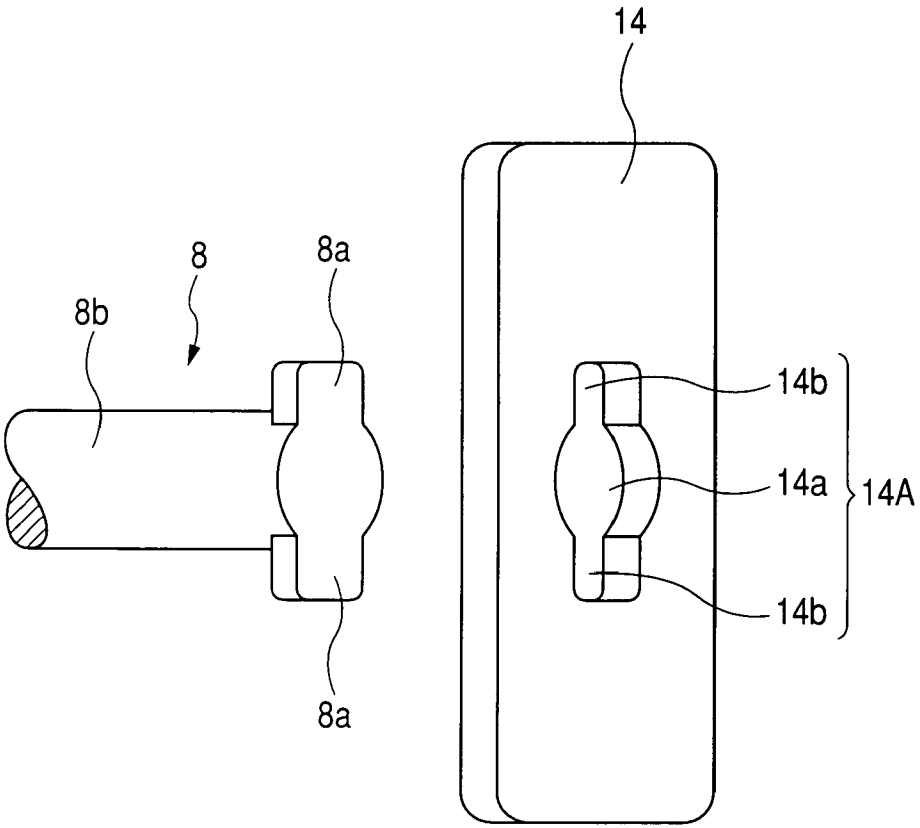
FIG. 3A shows a movable contact member not yet fitted to a shaft of the switch shown in FIG. 2.

Next, the fitting of the movable contact member 14 to the shaft 8 is described in detail with reference to FIGS. 3A and 3B. FIG. 3A shows the contact member 14 not yet fitted to the shaft 8, while FIG. 3B shows the contact member 14 fitted to the shaft 8.

As shown in FIG. 3A, the projection 8*a* is composed of one or more projecting portions which are, respectively, projected from a body 8*b* of the shaft 8 substantially along radial directions of the shaft 8. Therefore, the shaft 8 is formed in a hooked shape. The projection 8*a* may be composed of two projecting portions 8*a* projected opposite to each other. Each portion 8*a* is, for example, formed almost in a rectangular shape when the portion 8*a* is seen along the axial direction.

The movable contact member 14 has a hook receiving hole 14A corresponding to the projection 8*a*. That is, the hole 14A is shaped such that the projection 8*a* of the shaft 8 can pass through the hole 14A in conditions that the center axis of the shaft 8 is set to be substantially perpendicular to a surface of the contact member 14 having the hole 14A. More specifically, the hole 14A is partitioned into a circular hole 14*a* receiving the shaft body 8*b* and two sub-holes 14*b* receiving the projecting portions 8*a*. The hole 14*a* has an inner diameter slightly larger than an outer diameter of the shaft body 8*b*. The holes 14*b* are extended opposite to each other from the hole 14*a*. Each hole 14*b* is formed almost in a rectangular shape slightly larger than that of the projecting portion 8*a*.

Before the cover 3 is fixed to the frame 4, the contact member 14 is fitted to the shaft 8 protruded from the core 6. More specifically, as shown in FIG. 3B, the projecting portions 8*a* of the shaft 8 are inserted into the hole 14A of the movable contact member 14 so as to pass through the hole 14A, and the contact member 14 is rotated by 90 degrees around the center axis of the shaft 8 such that the projection 8*a* is engaged with or hooked on the contact member 14. Because the projection 8*a* collides with the contact member 14 when the contact member 14 is moved to be away from the plunger 7, the projection 8*a* prevents the contact member 14 from coming out of the shaft 8. Alternatively, the shaft 8 may be rotated on its center axis with respect to the movable contact member 14.

With this arrangement, because the projection 8*a* of the shaft 8 inserted into the hole 14A is disposed to be engaged with the contact member 14, the projection 8*a* can prevent the contact member 14 from coming out of the shaft 8 without using any washer for preventing the contact member 14 from coming out of the shaft 8 or without performing any attaching work such as caulking for attaching the contact member 14 to the shaft 8. Accordingly, the contact member 14 can be easily fitted to the shaft 8 at a low cost.

Further, because the shaft 8 is made of resin having insulation performance, no insulator is required between the shaft 8 and the contact member 14. Accordingly, the number of parts of the switch 1 can be reduced, and the switch 1 can be manufactured at low cost.

In this embodiment, the hole 14A of the contact member 14 has a size slightly larger than that of the projection 8*a*. Therefore, the projection 8*a* of the shaft 8 can pass through the hole 14A in conditions that the center axis of the shaft 8 is substantially perpendicular to the surface of the contact member 14 having the hole 14A. However, the hole 14A may have a size smaller than that of the projection 8*a* such that the projection 8*a* of the shaft 8 can pass through the hole 14A in conditions that the surface of the contact member 14 is inclined with respect to a plane substantially perpendicular to the center axis of the shaft 8. In other words, the hole 14A may be arbitrarily shaped on condition that the projection 8*a* of the shaft 8 can pass through the hole 14A.

Embodiment 2

Figure 4:
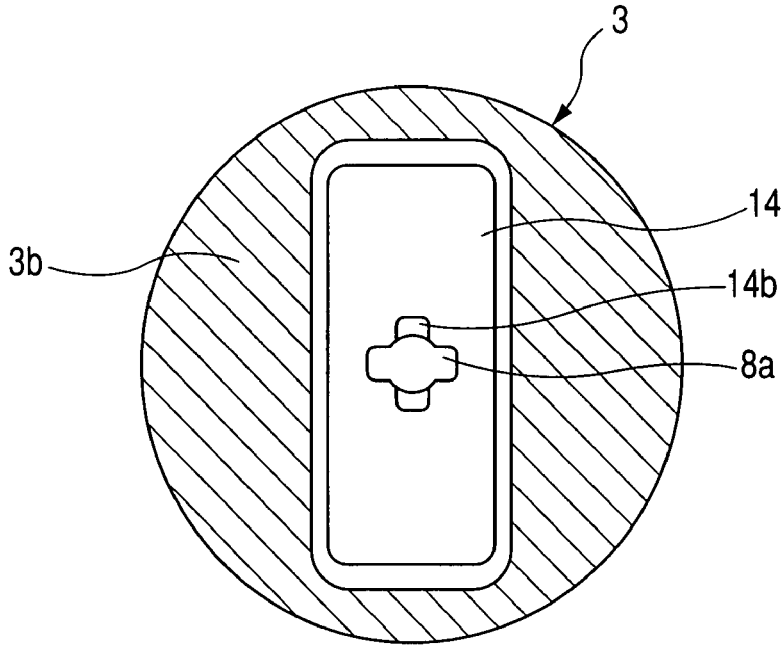
FIG. 4 is a sectional view taken substantially along line A-A of FIG. 2 to show the contact cover 3 surrounding the movable contact member 14 according to the second embodiment.

FIG. 4 is a sectional view taken substantially along line A-A of FIG. 2 to show the contact cover 3 surrounding the movable contact member 14 according to a second embodiment.

As shown in FIG. 4, the contact cover 3 has a projecting wall 3*b* protruded from the inner circumferential wall of the cover 3 and extending on a plane substantially perpendicular to the axial direction so as to surround the movable contact member 14. After the contact member 14 is fitted to the shaft 8, the cover 3 is fixed to the frame 4 such that the wall 3*b* is disposed so as to surround the contact member 14.

The wall 3*b* acts as a turn preventing member which prevents the contact member 14 from being turned or rotated around the center axis of the shaft 8 during the operation of the switch 1. Assuming that the contact member 14 is turned or rotated so as to place the projection 8*a* just on the holes 14*b*, the contact member 14 would come out of the shaft 8. However, in this embodiment, because the wall 3*b* prevents the turn of the contact member 14, the turn preventing member can maintain the engagement of the contact member 14 with the shaft 8. Accordingly, the combination of the projection 8*a* and the turn preventing member can reliably prevent the contact member 14 from coming out of the shaft 8.

In this embodiment, the wall 3*b* substantially occupies the entire space between the inner circumferential surface of the cover 3 and the contact member 4. However, in place of the wall 3*b*, the cover 3 may have a single bar-shaped projection or a plurality of bar-shaped projections protruded from the inner circumferential wall of the cover 3 toward the contact member 14 such that the projections placed near the contact member 14 prevent the contact member 14 from being turned or rotated around the center axis of the shaft 8 during the operation of the switch 1.

Embodiment 3

Figure 5:
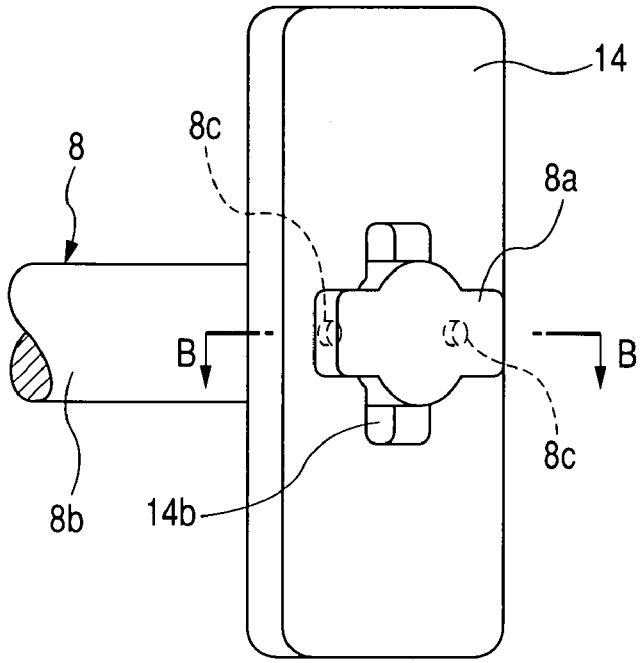
FIG. 5 is a perspective side view of the movable contact member fitted to the shaft according to a third embodiment.
Figure 6:
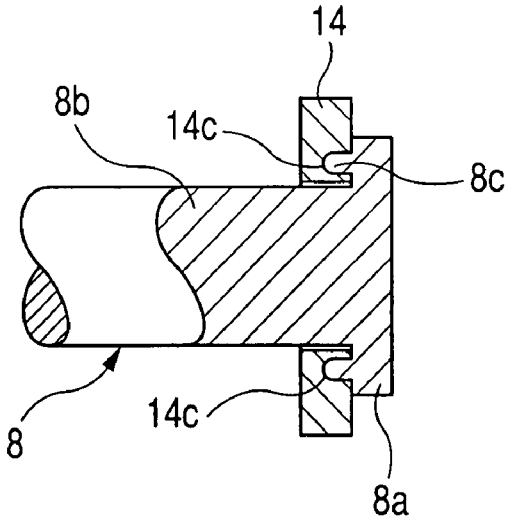
FIG. 6 is a sectional view taken substantially along line B-B of FIG. 5.

FIG. 5 is a perspective side view of the contact member 14 fitted to the shaft 8 according to a third embodiment, while FIG. 6 is a sectional view taken substantially along line B-B of FIG. 5.

As shown in FIGS. 5 and 6, each projecting portion 8*a* of the shift 8 has a convexity 8*c* protruding from a surface of the portion 8*a* facing the contact member 14, and the contact member 14 has a plurality of concavities 14*c* on its surface facing the projection 8*a* such that each concavity 14*c* receives one convexity 8*c*. After the contact member 14 disposed on the body 8*b* of the shaft 8 is turned, the convexities 8*c* are, respectively, fitted into the concavities 14*c*. Therefore, each set of convexity 8*c* and concavity 14*c* fitted to each other prevents the contact member 14 from being turned around the center axis of the shaft 8, thereby acting as a turn preventing member.

Accordingly, the engagement of the contact member 14 with the shaft 8 can reliably be maintained by the turn preventing member, and the combination of the projection 8*a* of the shaft 8 and the turn preventing member can reliably prevent the contact member 14 from coming out of the shaft 8.

The number of convexities 8*c* fitted into concavities 14*c* may be arbitrarily set. Further, all convexities 8*c* may be disposed only on one projecting portion 8*a* so as to be fitted into the concavities 14*c*. Moreover, convexities disposed on the contact member 14 may be received in concavities disposed on the projection 8*a* of the shaft 8.

Embodiment 4

Figure 7:
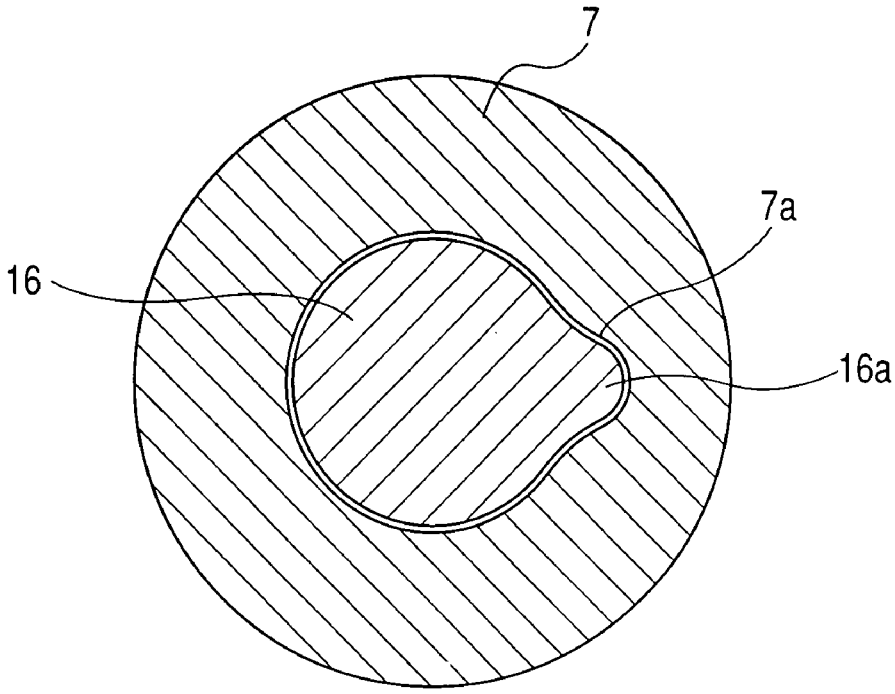
FIG. 7 is a sectional view taken substantially along line C-C of FIG. 2 and shows the engagement of a plunger with a joint of the switch according to a fourth embodiment.

FIG. 7 is a sectional view taken substantially along line C-C of FIG. 2 to show the engagement of the plunger 7 with the joint 16.

As shown in FIG. 7, the plunger 7 has an opening extending along the axial direction in the center thereof, and the joint 16 is disposed in the opening of the plunger 7. The joint 16 formed almost in a circular sectional shape has a convexity 16*a*, and the plunger 7 formed substantially in a circular shape in section has a concavity 7*a* such that the convexity 16*a* is engaged with the concavity 7*a*. Further, the joint 16 is engaged with a shift lever (not shown) so as not to be turned or rotated with the plunger 7. When the plunger 7 is inclined to be turned with the shaft 8 during the operation of the switch 1, the engagement of the convexity 16*a* with the concavity 7*a* prevents the plunger 7 from being turned. Therefore, the combination of the concavity 7*a* and convexity 16*a* prevents the contact member 14 from being turned around the center axis of the shaft 8, thereby acting as a turn preventing member.

Accordingly, the fitting of the contact member 14 with the shaft 8 can reliably be maintained by the turn preventing member, and the combination of the projection 8*a* of the shaft 8 and the turn preventing member can reliably prevent the contact member 14 from coming out of the shaft 8.

A convexity disposed on the plunger 7 may be received in a concavity disposed on the joint 16. Further, the joint 16 may be formed in an elliptical shape so as to be received in the plunger 7 having an elliptical opening. Moreover, any combination of the turn preventing members according to the second to fourth embodiments may be applied to the switch 1.

Embodiment 5

In this embodiment, the attachment of the contact member 14 to an insulator slidably supported by the shaft 8 is described.

Figure 8:
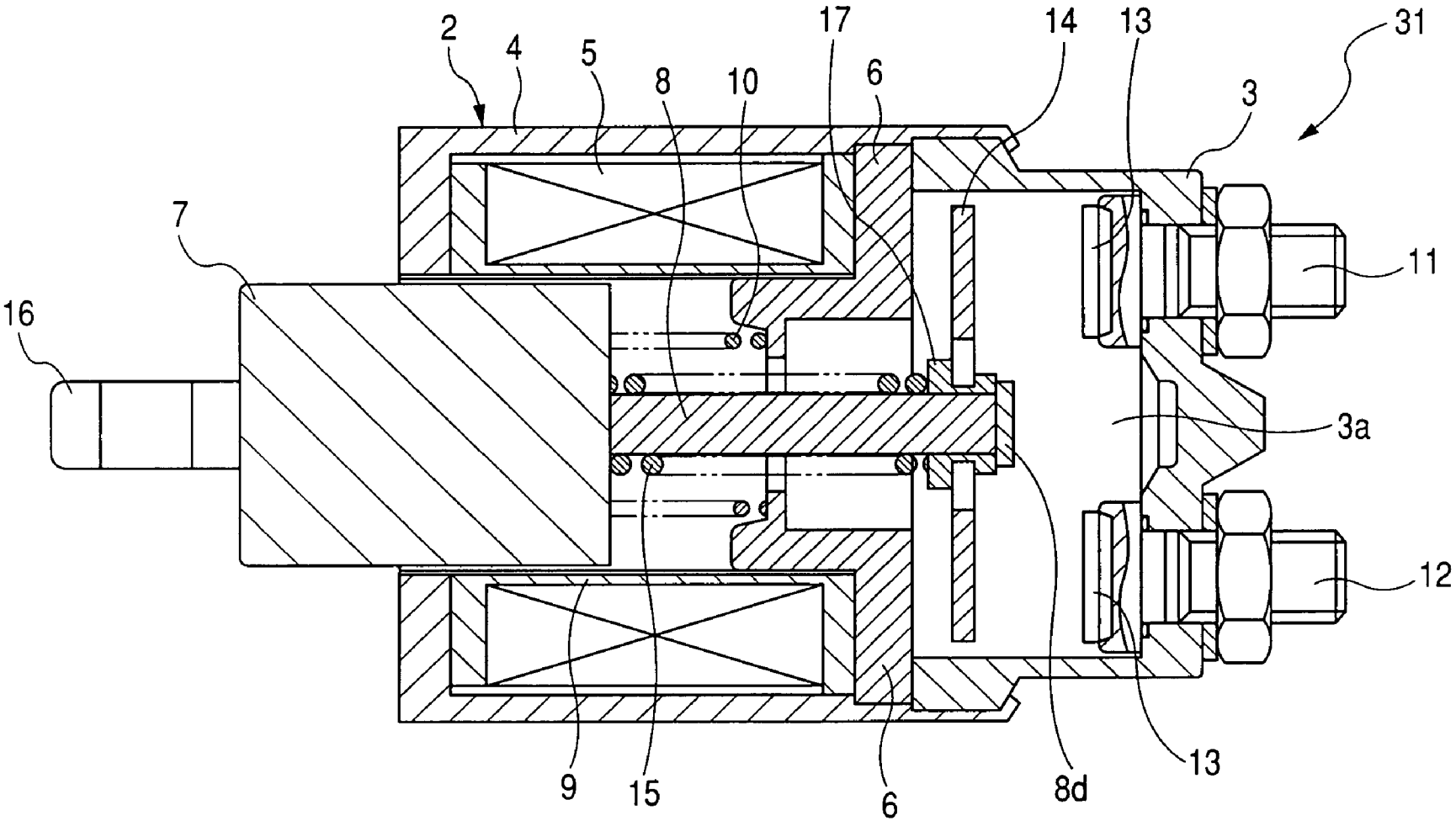
FIG. 8 is a longitudinal sectional view of an electromagnetic switch according to a fifth embodiment of the present invention.
Figure 9B:
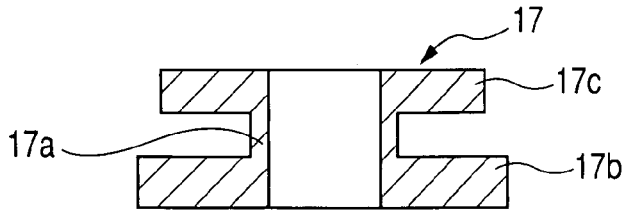
FIG. 9B is a sectional view taken substantially along line D-D of FIG. 9A.
Figure 9A:
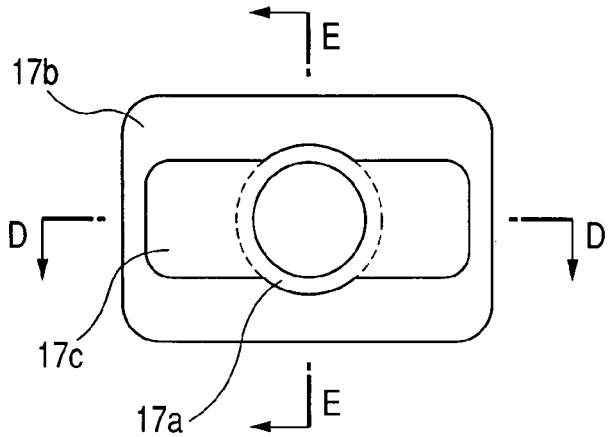
FIG. 9A is a plan view of an insulator of the switch shown in FIG. 8.
Figure 9C:
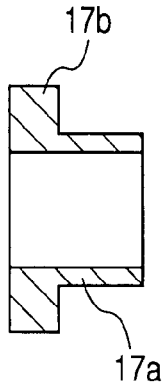
FIG. 9C is a sectional view taken substantially along line E-E of FIG. 9A.
Figure 10:
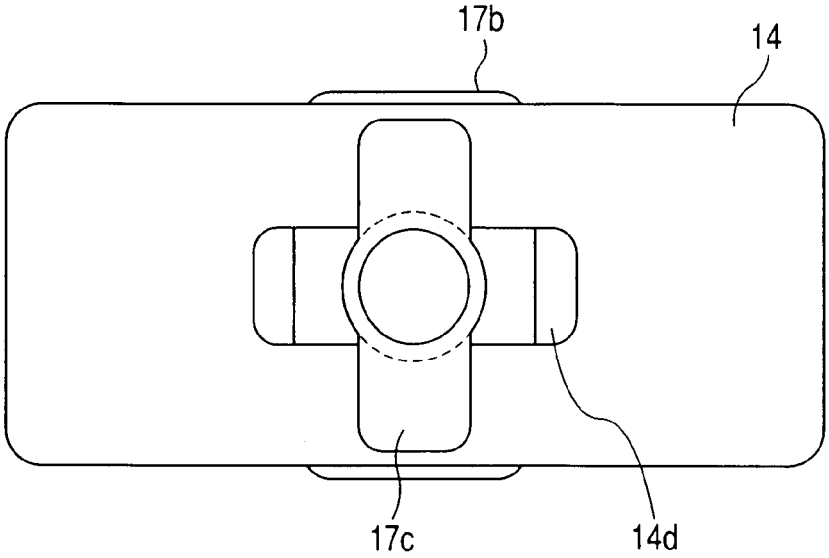
FIG. 10 is a plan view showing the fitting of the movable contact member to the insulator of the switch shown in FIG. 8.

FIG. 8 is a longitudinal sectional view of an electromagnetic switch according to a fifth embodiment. FIG. 9A is a plan view of an insulator of the switch, FIG. 9B is a sectional view taken substantially along line D-D of FIG. 9A, and FIG. 9C is a sectional view taken substantially along line E-E of FIG. 9A. FIG. 10 is a plan view showing the fitting of the contact member 14 to the insulator.

As shown in FIG. 8, an electromagnetic switch 31 according to the fifth embodiment differs from the switch 1 shown in FIG. 2 in that the contact member 14 is supported by the shaft 8 through an insulator 17. That is, the contact member 14 is attached to the insulator 17, and the insulator 17 is slidably supported by the shaft 8. The shaft 8 is made of a conductive material such as metal. The shaft 8 has a disc-shaped projection 8*d* having a diameter larger than that of the shaft body 8*b*. The spring 15 is disposed between the plunger 7 and the insulator 17.

As shown in FIGS. 9A to 9C, the insulator 17 has a cylindrical base portion 17*a* and two plate-shaped projecting portions 17*b* and 17*c* integrally formed with one another. The insulator 17 has a hole 17*d* surrounded by the base portion 17*a*. The hole 17*d* has an inner diameter substantially the same as an outer diameter of the shaft 8. The portions 17*b* and 17*c* are, respectively, disposed on both ends of the base portion 17*a* in an axial direction of the insulator 17. Each of the portions 17*b* and 17*c* is projected from the base portion 17*a* toward radial directions of the insulator 17 opposite to each other and substantially perpendicular to the axial direction. The height of the projecting portion 17*c* in the radial direction is smaller than the projecting portion 17*b*.

A process for attaching the contact member 14 to the insulator 17 is described.

The projecting portion 17*c* has substantially the same shape as that of the projection 8*a* of the shaft 8 shown in FIG. 3A. Therefore, the portion 17*c* acts as a hook of the insulator 17. As shown in FIG. 10, the contact member 14 has a hook receiving hole 14*d* corresponding to the shape of the portion 17*c* such that the portion 17*c* can pass through the hole 14*d*. Before the insulator 17 is fitted to the shaft 8, the contact member 14 is attached to the insulator 17. More specifically, the projecting portion 17*c* is inserted into the hole 14*d* of the contact member 14 so as to pass through the hole 14*d*, so that the contact member 14 is disposed on the base portion 17*a* between the portions 17*b* and 17*c*. Then, one of the contact member 14 and the insulator 17 is turned by 90 degrees around the center axis of the insulator 17 with respect to the other one. Therefore, the contact member 14, that is movable, is engaged with or hooked on the base portion 17*c* such that the portion 17*c* prevents the contact member 14 from coming out of the insulator 17.

A process for fitting the insulator 17 to the shaft 8 is described. Before the shaft 8 is attached to the plunger 7, an end portion of the shaft 8 placed on the opposite side of the projection 8*d* is inserted into the hole 17*d* of the insulator 17 with the contact member 14 such that the portion 17*a* and portion 17*b* or 17*c* come in contact with the projection 8*d* of the shaft 8. Therefore, the insulator 17 is slidably fitted to the shaft 8, while the projection 8*d* of the shaft 8 prevents the insulator 17 from coming out of the shaft 8. Then, the end portion of the shaft 8 is attached to the plunger 7, and the cover 3 is fixed to the frame 4.

Accordingly, the projecting portion 17*c* of the insulator 7 can prevent the contact member 14 from coming out of the insulator 17 without using any washer or without performing any troublesome attaching work such as caulking, and the contact member 14 can easily be fitted to the shaft 8 through the insulator 17 at a low cost.

Further, because the portions 17*a* to 17*c* of the insulator 17 are integrally formed with one another as a single constitutional part, the number of parts in the switch 31 can be reduced as compared with a prior art wherein an insulator is divided into two portions.

In this embodiment, any of the turn preventing members according to the second to fourth embodiments may be applied to attach the contact member 14 to the insulator 17.

Further, the portion 17*b* of the insulator 17 acts to fix the contact member 14 on the base portion 17*a* in cooperation with the portion 17*c*. However, because the spring 15 disposed between the plunger 7 and the portion 17*b* can fix the contact member 14 on the base portion 17*a* in cooperation with the portion 17*c*, the portion 17*b* may be omitted from the insulator 17.

Moreover, any one or combination of the turn preventing members according to the second and third embodiments may be applied to the switch 31.

Embodiment 6

Figure 11:
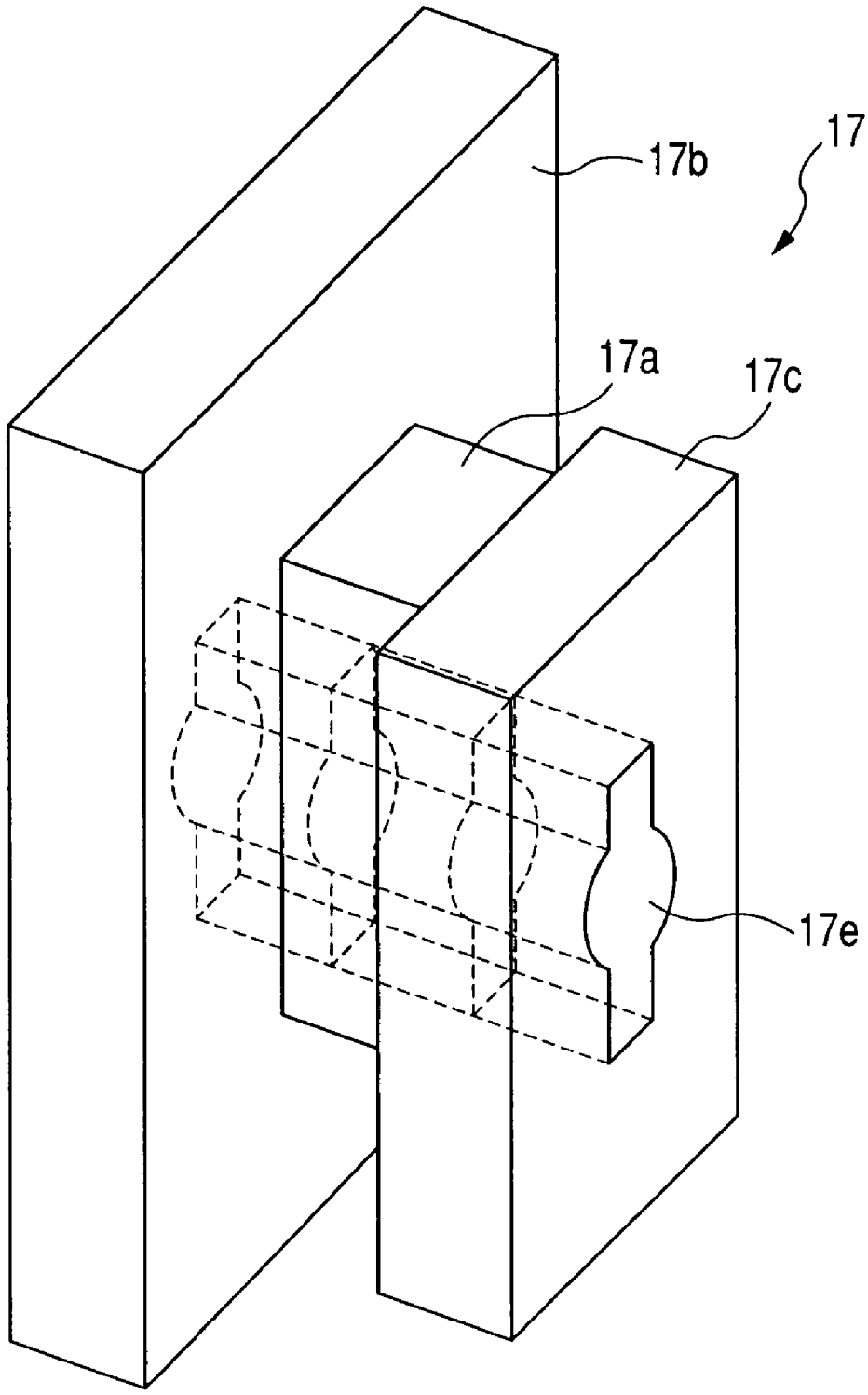
FIG. 11 is a perspective side view of an insulator shown in FIG. 8 according to a sixth embodiment of the present invention.

In this embodiment, the fitting of the insulator 17 to the shaft 8 is described. FIG. 11 is a perspective side view of the insulator 17 according to a sixth embodiment.

As shown in FIG. 11, the insulator 17 according to the sixth embodiment differs from that shown in FIG. 9A in that the insulator 17 has a hook receiving hole 17*e* corresponding to the shape of the projection 8*a* of the shift 8, so that the projection 8*a* shown in FIG. 3A can pass through the hole 17*e* of the insulator 17.

After the contact member 14 is attached to the insulator 17 according to the fifth embodiment, the insulator 17 with the contact member 14 is fitted to the shaft 8 attached to the plunger 7. More specifically, the insulator 17 is disposed such that the projecting portion 17*b* or 17*c* faces the projection 8*a* of the shaft 8 shown in FIG. 3A, and the projection 8*a* is inserted into the hole 17*e* of the insulator 17 such that the projection 8*a* passes through the insulator 17. Then, the insulator 17 is turned around the center axis of the shaft 8 by 90 degrees with respect to the shaft 8, so that the projecting portion 17*c* or 17*b* is engaged with the projection 8*a*. Therefore, the projection 8*a* prevents the insulator 17 from coming out of the shaft 8, and the insulator 17 is slidably fitted to the shaft 8.

Accordingly, the projection 8*a* can prevent the insulator 17 from coming out of the shaft 8 without using any washer or without performing any attaching work such as caulking, and the contact member 14 can easily be fitted to the shaft 8 through the insulator 17 at a low cost.

In this embodiment, any one or combination of the turn preventing members according to the second to fourth embodiments may be applied to the switch 31.

What is claimed is:

1. An electromagnetic switch comprising:

an electromagnet which generates a magnetic force in response to an electric current supplied to an electromagnetic coil and attracts a plunger toward a first direction;

a shaft which is moved with the plunger along the first direction;

two fixed contact members being separated from each other; and a movable contact member which is slidably supported by the shaft and connects the fixed contact members with each other in response to the movement of the shaft, wherein the shaft has a shaft body extending along the first direction and a projection projected from the shaft body along a second direction different from the first direction, the projection of the shaft has a hooked shape, the movable contact member has a hole in which the shaft body is disposed, and the hole of the movable contact member has a hook receiving shape corresponding to the shape of the projection such that the projection of the shaft penetrates through the hole and is hooked on the movable contact member to be is engaged with the movable contact member and to maintain the shaft body in the hole of the movable contact member.

2. The switch according to claim 1, wherein the shaft is made of a resin material having an insulation performance.

3. The switch according to claim 1, further comprising a turn preventing member which prevents a relative turn of the movable contact member to the shaft around a center axis of the shaft.

4. The switch according to claim 3, wherein the turn preventing member is disposed on an inner surface of a contact cover surrounding the movable contact member so as to prevent the rotation of the movable contact member.

5. The switch according to claim 3, wherein the turn preventing member is a convexity disposed on the projection of the shaft and a concavity disposed on the movable contact member, and the convexity is fitted to the concavity.

6. The switch according to claim 3, wherein the turn preventing member is a convexity disposed on one of the plunger and a joint moved with the plunger and a concavity disposed on the other, of the plunger and the joint moved with the plunger and the convexity is fitted to the concavity to prevent the rotation of the shaft.

7. The switch according to claim 3, wherein the turn preventing member is a convexity disposed on the movable contact member and a concavity disposed on the projection of the shaft, and the convexity is fitted to the concavity.

8. The switch according to claim 1, wherein the projection of the shaft passes through the hole of the movable contact member and is engaged with the movable contact member to prevent the movable contact member from coming out of the shaft.

* * * * *